US007654315B2

(12) United States Patent
Du et al.

(10) Patent No.: US 7,654,315 B2
(45) Date of Patent: Feb. 2, 2010

(54) APPARATUS, PUMPING SYSTEM INCORPORATING SAME, AND METHODS OF PROTECTING PUMP COMPONENTS

(75) Inventors: Michael H. Du, Pearland, TX (US); John D. Rowatt, Pearland, TX (US); Cheryl R. DuVall, Bartlesville, OK (US); Michael W. Miller, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 213 days.

(21) Appl. No.: 11/307,842

(22) Filed: Feb. 24, 2006

(65) Prior Publication Data

US 2007/0074872 A1 Apr. 5, 2007

Related U.S. Application Data

(60) Provisional application No. 60/596,523, filed on Sep. 30, 2005.

(51) Int. Cl.
*E21B 43/00* (2006.01)

(52) U.S. Cl. ..... 166/105; 166/68; 166/66.4

(58) Field of Classification Search ..... 166/369, 166/106

See application file for complete search history.

(56) References Cited

U.S. PATENT DOCUMENTS 1,891,771 A * 12/1932 Mendenhall et al. ..... 417/414
2,881,013 A 4/1959 Myers
3,677,665 A 7/1972 Corkill
3,876,139 A * 4/1975 Schmidt, Jr. ..... 236/56
3,947,709 A * 3/1976 Waltman ..... 310/87
4,053,398 A 10/1977 Venema
4,421,999 A 12/1983 Beavers et al.
4,436,488 A 3/1984 Witten
4,453,892 A * 6/1984 Brookbank, III ..... 417/279
4,477,235 A 10/1984 Gilmer et al.
4,492,523 A 1/1985 Knox
4,558,247 A * 12/1985 Yamamoto et al. ..... 310/87
4,583,923 A 4/1986 James
4,770,678 A 9/1988 Haslett
4,936,386 A 6/1990 Colangelo (Continued)

FOREIGN PATENT DOCUMENTS

CN 1080366 A 6/1992

(Continued)

*Primary Examiner*—David J Bagnell
*Assistant Examiner*—Cathleen R Hutchins
(74) *Attorney, Agent, or Firm*—Kevin Brayton McGoff; James L. Kurka; Van Someren, PC

(57) ABSTRACT

Apparatus and pumping systems including the apparatus are described, the apparatus including a protector body comprising a material allowing expansion and contraction of an internal fluid, the body serving as a barrier between fluids external of the body and the internal fluid. The body has first and second ends, at least one end adapted to connect the body to other components, the protector body further comprising structural features permitting facile cleanout and reuse of the protector body. Methods of use of the apparatus and systems are described, particularly in oilfield exploration, testing, and production. This abstract allows a searcher or other reader to quickly ascertain the subject matter of the disclosure. It will not be used to interpret or limit the scope or meaning of the claims.

13 Claims, 3 Drawing Sheets

U.S. PATENT DOCUMENTS

| | | | | |
|---|---|---|---|---|
| 4,940,911 | A | 7/1990 | Wilson | |
| 4,992,689 | A | 2/1991 | Bookout | |
| 5,002,128 | A | 3/1991 | Wiseman, Jr. | |
| 5,367,214 | A | 11/1994 | Turner, Jr. | |
| 5,548,116 | A | 8/1996 | Pandelisev | |
| 5,554,897 | A * | 9/1996 | Martin et al. | 310/54 |
| 5,622,222 | A | 4/1997 | Wilson et al. | |
| 5,647,435 | A | 7/1997 | Owens et al. | |
| 5,795,135 | A | 8/1998 | Nyilas et al. | |
| 5,796,197 | A | 8/1998 | Bookout | |
| 6,059,539 | A | 5/2000 | Nyilas et al. | |
| 6,100,616 | A | 8/2000 | Heinig et al. | |
| 6,242,829 | B1 * | 6/2001 | Scarsdale | 310/87 |
| 6,688,860 | B2 | 2/2004 | Du et al. | |
| 6,851,935 | B2 * | 2/2005 | Merrill et al. | 417/53 |
| 6,971,848 | B2 | 12/2005 | Watson | |
| 6,979,174 | B2 | 12/2005 | Watson et al. | |
| 6,981,853 | B2 | 1/2006 | Du et al. | |
| 2004/0136849 | A1 * | 7/2004 | Du et al. | 417/423.11 |
| 2005/0167096 | A1 | 8/2005 | Du | |

FOREIGN PATENT DOCUMENTS

| | | |
|---|---|---|
| EP | 0 441 464 B1 | 5/1997 |
| RU | 2267653 | 9/2005 |
| SU | 1000603 | 5/1983 |
| WO | WO 97/21055 A1 | 6/1997 |

* cited by examiner

APPARATUS, PUMPING SYSTEM INCORPORATING SAME, AND METHODS OF PROTECTING PUMP COMPONENTS

CROSS-REFERENCE TO RELATED APPLICATIONS

The present application claims priority under 35 U.S.C. § 119 to United States Provisional Application Ser. No. 60/596,523, filed Sep. 30, 2005, incorporated by reference herein in its entirety.

BACKGROUND OF THE INVENTION

1. Field of Invention

The present invention relates generally to the field of oilfield exploration, production, and testing, and more specifically to protection of pump components used in such ventures.

2, Related Art

Electrical submersible pumps (ESPs) are used for artificial lifting of fluid from a well or reservoir. An ESP typically comprises an electrical submersible motor, a seal section (sometimes referred to in the art as a protector) which functions to equalize the pressure between the inside of the system and the outside of the system and also acts as a reservoir for compensating the internal oil expansion from the motor; and a pump having one or more pump stages inside a housing. The protector may be formed of metal, as in a bellows device, or an elastomer, in which case the protector is sometimes referred to as a protector bag.

A variety of production fluids are pumped from subterranean environments. Different types of submersible pumping systems may be disposed in production fluid deposits at subterranean locations to pump the desired fluids to the surface of the earth. For example, in producing petroleum and other useful fluids from production wells, it is generally known to provide a submersible pumping system for raising the fluids collected in a well. Production fluids (e.g., petroleum) enter a wellbore drilled adjacent a production formation. Fluids contained in the formation collect in the wellbore and are raised by the submersible pumping system to a collection point at or above the surface of the earth.

In addition to motors, pump sections, and seals, a typical submersible pumping system may further comprise a variety of additional components, such as a connector used to connect the submersible pumping system to a deployment system. Conventional deployment systems include production tubing, cable and coiled tubing. Additionally, power is supplied to the submersible electric motor via a power cable that runs through or along the deployment system.

Often, the subterranean environment (specifically the well fluid) and fluids that are injected from the surface into the wellbore (such as acid treatments) contain corrosive compounds that may include carbon dioxide, hydrogen sulfide, and brine water. These corrosive agents can be detrimental to components of the submersible pumping system, particularly to internal electric motor components, such as copper windings and bronze bearings. Moreover, irrespective of whether or not the fluid is corrosive, if the fluid enters the motor and mixes with the motor oil, the fluid can degrade the dielectric properties of the motor oil and the insulating materials of the motor components. Accordingly, it is highly desirable to keep these external fluids out of the internal motor fluid and components of the motor.

Submersible electric motors are difficult to protect from corrosive agents and external fluids because of their design requirements that allow use in the subterranean environment. A typical submersible motor is internally filled with a fluid, such as a dielectric oil, that facilitates cooling and lubrication of the motor during operation. As the motor operates, however, heat is generated, which, in turn, heats the internal motor fluid causing expansion of the oil. Conversely, the motor cools and the motor fluid contracts when the submersible pumping system is not being used.

In many applications, submersible electric motors are subject to considerable temperature variations due to the subterranean environment, injected fluids, and other internal and external factors. These temperature variations may cause undesirable fluid expansion and contraction and damage to the motor components. For example, the high temperatures common to subterranean environments may cause the motor fluid to expand excessively and cause leakage and other mechanical damage to the motor components. These high temperatures also may destroy or weaken the seals, insulating materials, and other components of the submersible pumping system. Similarly, undesirable fluid expansion and motor damage can also result from the injection of high-temperature fluids, such as steam, into the submersible pumping system.

Accordingly, this type of submersible motor benefits from a motor fluid expansion system able to accommodate the expanding and contracting motor fluid. The internal pressure of the motor must be allowed to equalize or at least substantially equalize with the surrounding pressure found within the wellbore. As a result, it becomes difficult to prevent the ingress of external fluids into the motor fluid and internal motor components.

Numerous types of motor protectors have been designed and used in isolating submersible motors while permitting expansion and contraction of the internal motor fluid. A variety of elastomeric bladders alone or in combination with labyrinth sections have been used as a barrier between the well fluid and the motor fluid. For example, expandable elastomeric bags or bladders have been used in series to prevent mixing of wellbore fluid with motor fluid while permitting expansion and contraction of the motor fluid. Another type of protector employs a bellows, such as a one-piece annular bellows.

As may thus be seen, there remains a need in the natural resources exploration and production field for improving reliability and life of motor protectors. The present invention is directed at providing such protectors.

SUMMARY OF THE INVENTION

In accordance with the present invention, apparatus, systems and methods are described that reduce or overcome problems in previously known apparatus and systems.

A first aspect of the invention are apparatus comprising:

(a) a protector body comprising a material allowing expansion and contraction of an internal fluid, and serving as a barrier between fluids external of the protector body and the internal fluid, the protector body having first and second ends, at least one of the first and second ends adapted to connect the protector body to another pump component, the second end optionally adapted to connect the protector body to a motor seal;

(b) the protector body further comprising structural features permitting facile cleanout and reuse of the protector body.

Various apparatus embodiments of the present invention may be employed in systems and methods for protecting a motor of a pump exposed to a subterranean environment, for example a submersible pumping system. Apparatus of the invention in these embodiments may be termed motor protectors. Apparatus of the invention may be used to protect motors and other components in any combination. As used herein the phrase "structural features permitting facile cleanout" means that in certain apparatus embodiments, the body comprises an assembly of two or more pieces that may be disassembled and cleaned without great difficulty, as compared with conventional single piece bellows apparatus. Certain multi-piece bellows assemblies of the invention may be dismantled and cleaned in a simpler fashion than one-piece bellows. For instance, the multiple-piece bellows may be cleaned with by steam cleaning, or other methods including but not limited to chemical cleaning, ultrasonic cleaning, baking, blasting, and combinations thereof to significantly reduce the cost for the bellows cleaning processes. When mentioning apparatus of the invention comprising an assembly of two or more pieces or components, the pieces or components may be arranged in any number of ways within the invention, such as concentric bellows (inner and outer bellows); one outer bellows and two inner bellows in series, each of shorter length than the outer bellows; one outer bellows and three shorter inner bellows in series, one bellows fastened to another component, and the like. Conventional apparatus may be used in combination with apparatus of the invention, for example in series or parallel. Apparatus of the invention, whether the same or different, may also be used in series or in parallel.

Apparatus of the invention may comprise materials able to withstand temperatures, pressures, temperature and pressure variations, and a variety of organic, inorganic and mixtures of inorganic and organic compositions. Suitable materials for the body and ends of apparatus of the invention include metals, such as Hastelloy C, an Inconel, a heat treated stainless steel, or titanium, combinations and composites of metals and polymeric materials, and layered and coated versions of metals, wherein individual layers and coatings may be the same or different in composition and thickness. Bellows assemblies may be constructed from suitable materials that are resistant (e.g., impermeable) to the hot and corrosive environment within the wellbore, such as Kalrez, Chemrez, or Inconel 625. If a polymeric material is used, the polymeric material may be a composite polymeric material, such as, but not limited to, polymeric materials having fillers, plasticizers, and fibers therein. The polymeric material may comprise one or more thermoplastic polymers, one or more thermoset polymers, one or more elastomers, and combinations thereof. Apparatus within the invention include those wherein the apparatus may or may not be integral with the motor. Each of these motor protectors also may have various moisture absorbents, filters, particle shedders and various conventional motor protector components.

Another aspect of the invention are pumping systems which may be used in natural resources exploration, production, and/or testing, one pumping system comprising:

(a) one or more pump components; and (b) one or more apparatus of the first aspect of the invention connected to the pump component.

Yet another aspect of the invention are methods of protecting pump components, for example during activities such as raising hydrocarbons from an underground or undersea reservoir, one method comprising:

(a) selecting one or more pumping systems of the invention; and (b) using the pumping system in an oilfield operation, the oilfield operation exposing the pumping system to a wellbore environment.

Methods of the invention may include, but are not limited to, running one or more oilfield tools into the wellbore prior to, during, or after using the pumping system. Methods of the invention also include those wherein the pumping system is used to raise a hydrocarbon from a reservoir, or circulate either a hydrocarbon or other composition in at least a portion of a well bore, and/or retrieve an oilfield element from the wellbore. The wellbore environment during any of these methods may stay substantially the same or vary during the oilfield operation.

The various aspects of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
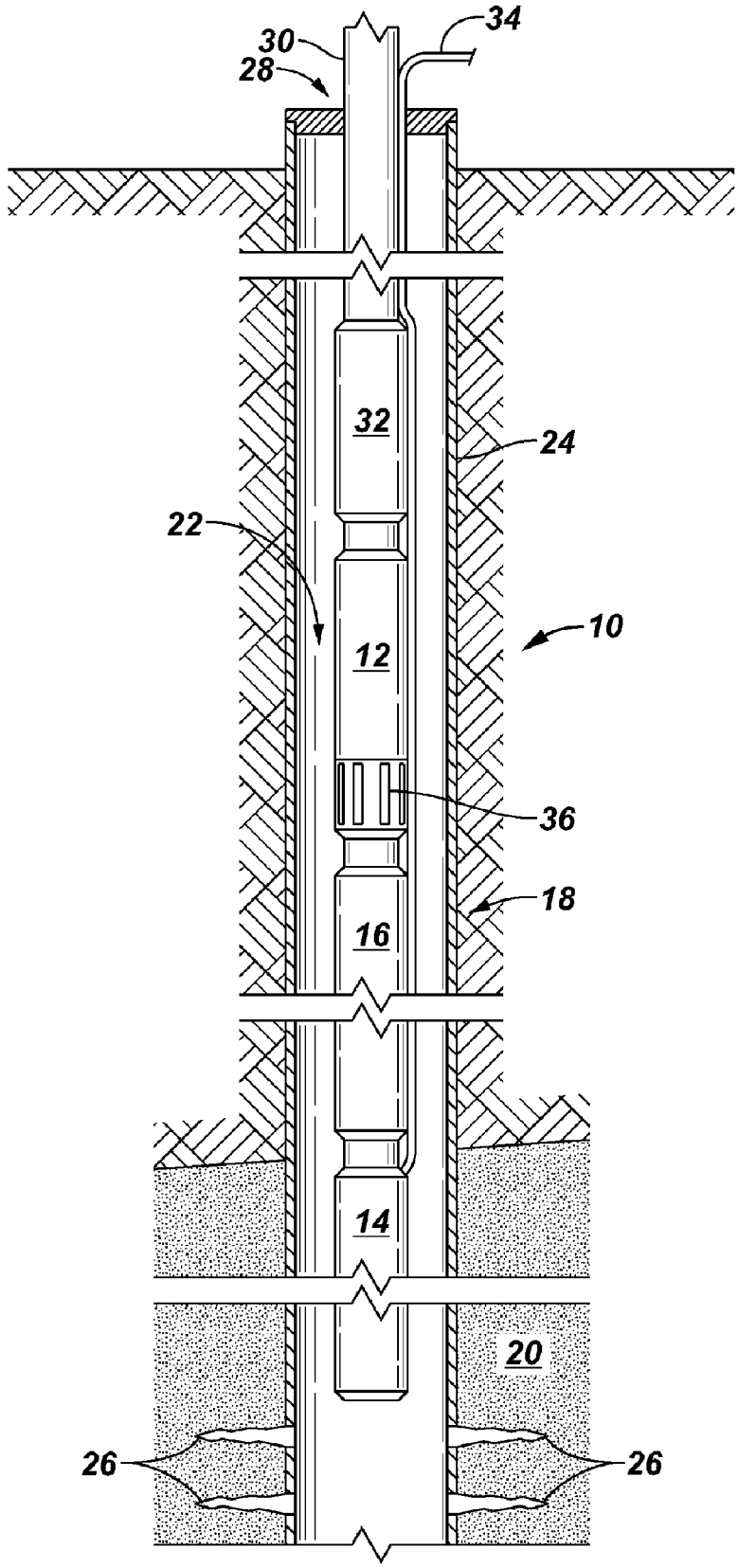
FIG. 1 is a front elevation view of a prior art electrical submersible pump disposed within a wellbore.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes apparatus, systems incorporating same, and methods of using the apparatus and systems in oilfield applications, including exploration, testing, drilling, and production activities. As used herein the term "oilfield" includes land based (surface and sub-surface) and sub-seabed applications. The term "oilfield" as used herein includes hydrocarbon oil and gas reservoirs, and formations or portions of formations where hydrocarbon oil and gas are expected but may ultimately only contain water, brine, or some other composition. A typical use of apparatus and systems of the invention will be in wellbore applications, such as pumping fluids from or into wellbores.

Various apparatus embodiments of the present invention may be employed in systems and methods for protecting a motor of a pump exposed to a subterranean environment, for example a submersible pumping system. Apparatus of the invention in these embodiments may be termed motor protectors. Apparatus of the invention may be used to protect motors and other components in any combination. In certain apparatus embodiments, the body comprises an assembly of two or more pieces that may be disassembled and cleaned without great difficulty, as compared with conventional single piece bellows apparatus. Certain multi-piece bellows assemblies of the invention may be dismantled and cleaned in a simpler fashion than one-piece bellows. For instance, the multiple-piece bellows may be cleaned with a commercial steam cleaner, or other methods including but not limited to chemical cleaning and ultrasonic cleaning to significantly reduce the cost for the bellows cleaning processes. When mentioning apparatus of the invention comprising an assembly of two or more pieces or components, the pieces or components may be arranged in any number of ways within the invention, such as concentric bellows (inner and outer bellows); one outer bellows and two inner bellows in series, each of shorter length than the outer bellows; one outer bellows and three shorter inner bellows in series, and the like. Conventional apparatus may be used in combination with apparatus of the invention, for example in series or parallel. Apparatus of the invention, whether the same or different, may also be used in series or in parallel.

Apparatus of the invention may comprise materials able to withstand temperatures, pressures, temperature and pressure variations, and a variety of organic, inorganic and mixtures of inorganic and organic compositions expected or unexpected in a wellbore. A "wellbore" may be any type of well, including, but not limited to, a producing well, a non-producing well, an injection well, a fluid disposal well, an experimental well, an exploratory well, and the like. Wellbores may be vertical, horizontal, deviated some angle between vertical and horizontal, and combinations thereof, for example a vertical well with a non-vertical component. Suitable materials for the body and ends of apparatus of the invention include metals, polymeric apparatus selected from natural and synthetic polymers, combinations and composites of metals and polymeric materials, and layered and coated versions of polymers and metals, wherein individual layers and coatings may be the same or different in composition and thickness. If a polymeric material is used, the polymeric material may be a composite polymeric material, such as, but not limited to, polymeric materials having fillers, plasticizers, and fibers therein. Apparatus within the invention include those wherein the apparatus may or may not be integral with the motor. Using metal bellows extends temperature operating limits far beyond those of polymeric bag-type protectors in extreme temperatures. In the case of gassy wells, metal apparatus may prevent gas from migrating through the apparatus and displacing the motor oil. Metals that are resistant to $H_2S$ and impermeable to gas may be employed in wellbores having harsh environments, i.e., high temperature and $H_2S$, as well as high hydrocarbon gas content.

Apparatus and systems of the invention may thus be especially useful in steam flood injection operations, such as steam-assisted gravity drainage (SAGD) projects. As is known, conventional oil production is declining in Canada, but oil production from tar sands and other heavy oil sources using SAGD is increasing. In the SAGD process, two parallel, horizontal wells are drilled, steam is injected in the upper well, which is approximately 5 meters above the lower, producing wellbore. The injected steam rises in the formation and heats the oil (having a gravity of less than 10° API), which flows down to the producing wellbore by gravity drainage. Formerly, gas-lift was used to produce the SAGD wells, however, gas-lift requires high power (for compression) and there may be problems with instability due to the horizontal wellbores. Using an ESP, production is controlled. The produced emulsion is produced to the treating plant. By using the ESP, the pump intake pressure, and thus the flowing bottom-hole pressure can be reduced. The lower reservoir pressure helps to optimize the steam coverage and use in the reservoir. The ESP may be that known under the trade designation "Hotline" 550, available from Schlumberger, Houston, Tex., rated for 218° C. (425° F.). Production rate presently ranges from about 300-1000 M3/Day, or 1900-6300 B/D. The pumps are landed in the horizontal portion of the wellbore, and experience a rapid temperature increase. The temperature at the surface may be very low. The wells produce approximately 1% sand. The ESP may use a variable speed drive. Challenges presented include the high temperature in the reservoir, sand, temperature cycles, setting the pump in the horizontal wellbore, and maintaining clean the dielectric motor oil. Despite the use of advanced insulation, all steel stators, high-temperature di-electric motor cooling oil, elastomers able to withstand up to 550° F., high temperature pothole, and metal bellows having seal and bellows sections, as taught in assignee's U.S. Pat. No. 6,688,860, the search for improvements remains an active area. One area in need of improvement is the ability to clean the motor protector in a timely and cost effective manner. The apparatus and systems of the present invention address this need.

Referring generally to FIG. 1, an exemplary pumping system 10, such as a submersible pumping system, is illustrated. Pumping system 10 may comprise a variety of components depending on the particular application or environment in which it is used. Typically, system 10 has at least a submersible pump 12, a motor 14, and a motor protector 16. Motor 14 may comprise any electric motor or other motor that requires volume compensation based on, for instance, the thermal expansion and/or contraction of internal fluid. Submersible pump 12 may be of a variety of types, e.g. a centrifugal pump, an axial flow pump, or a combination thereof. System 10 may also comprise a gearbox, as is known in the art.

In the illustrated embodiment, pumping system 10 is designed for deployment in a well 18 within a geological formation 20 containing desirable production fluids, such as petroleum. In a typical application, a wellbore 22 is drilled and lined with a wellbore casing 24. Wellbore casing 24 typically has a plurality of openings 26 (e.g. perforations) through which production fluids may flow into wellbore 22. While FIG. 1 illustrates a system in vertical orientation, this is merely for convenience. As previously explained, in SAGD production the wellbore section would be illustrated as horizontal.

Pumping system 10 is deployed in wellbore 22 by a deployment system 28 that may have a variety of forms and configurations. For example, deployment system may comprise tubing 30 connected to pump 12 by a connector 32. Power is provided to submersible motor 14 via a power cable 34. Motor 14, in turn, powers centrifugal pump 12, which draws production fluid in through a pump intake 36 and pumps the production fluid to the surface via tubing 30.

It should be noted that the illustrated submersible pumping system 10 is merely an exemplary embodiment. Other components can be added to the system, and other deployment systems may be implemented. Additionally, the production fluids may be pumped to the surface through tubing 30 or through the annulus formed between deployment system 28 and wellbore casing 24. In any of these configurations of submersible pumping system 10, it is desirable to attain maximum protection and life of the motor fluid, the motor 14 and the motor protector 16 in accordance with the present invention.

In embodiments of the present invention, system 10 may have multiple sections of the motor protector 16 disposed about the motor 14. As illustrated, system 10 comprises the pump 12, motor 14, and various motor protection components disposed in a housing. Pump 12 is rotatably coupled to the motor 14 via a shaft, which extends lengthwise through the housing (e.g., one or more housing sections coupled together). System 10 and the shaft may have multiple sections, which can be intercoupled via couplings and flanges. For example, the shaft may have couplings and an intermediate shaft section disposed between pump 12 and motor 14.

Generally, conventional bellows protectors use an annular bellows (or in some cases two layers of bellows, or alternatively a small bellows inside a big bellows) to allow the shaft to pass through the center of the bellows. At one end of the annular bellows, the big and small bellows may be welded to an end plate, but may otherwise be free. At the other end, both the big and small bellows may be welded to a flange for installing the bellows onto another part of the protector during assembly, such as a protector seal section. In the flange, there are several holes for fluid communication. Accordingly, if some wellbore debris gets into such a one-piece bellows, it may be very difficult to clean.

Some embodiments of systems of the invention employ a multi-piece bellows (e.g., a two-piece bellows, or a single bellows with another component) that can be dismantled and cleaned, so the cleaning process may be much easier and less expensive. Moreover, the quality of bellows cleaning may be significantly enhanced to provide more reliable operation of the bellows downhole.

Figure 2:
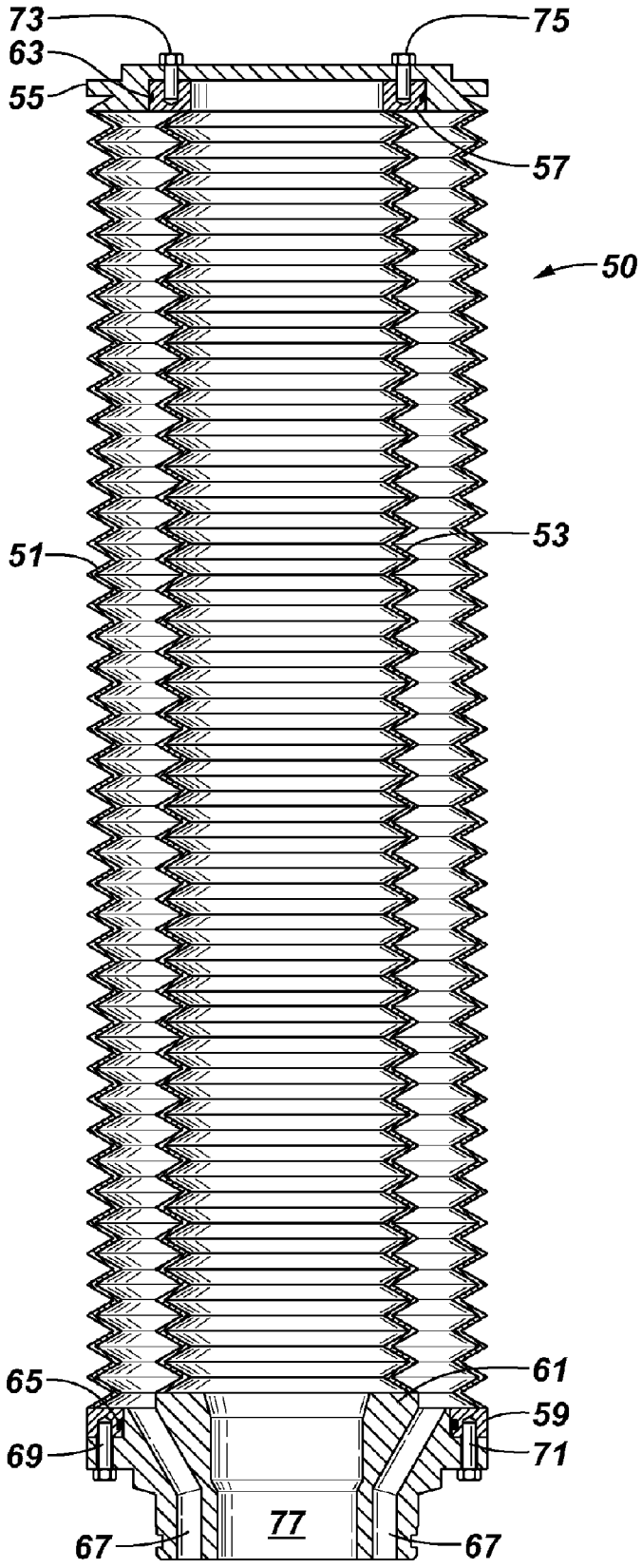
FIG. 2 is a schematic cross-section view through the longitudinal axis of a two-piece protector apparatus in accordance with the invention.
Figure 4:
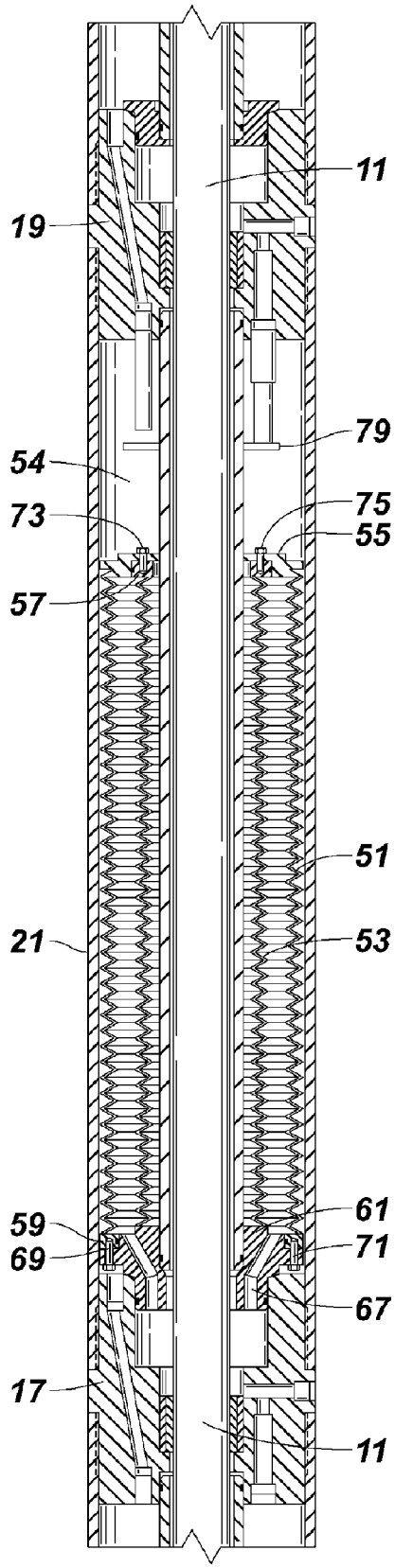
FIG. 4 is a more detailed schematic cross-sectional view of a portion of the system of FIG. 3.

The present invention encompasses various ways using multi-piece bellows in a protector assembly. For example, the bellows can be designed into one, two, or more pieces depending on the actual cost and manufacturing capability. FIG. 2 illustrates in cross-section an embodiment 50 having a bellows that is in two pieces. One piece is an external bellows 51, and another piece is an internal bellows 53. Both bellows have upper and lower flanges so that the two bellows can be connected together to form an annular bellows. External bellows 51 is welded to an upper flange 55 and a lower flange 59, while internal bellows 53 is welded to an upper flange 57 and a lower flange 61. In some embodiments, like the embodiment illustrated in FIG. 2, o-rings 63 and 65 provide seals between each pair of the flanges to be connected together. Lower flange 61 of internal bellows 53 has one or more fluid communication ports 67, and flange 61 may serve as a male portion fitting into a female seat of a protector seal body 17 (FIG. 4). The bellows assembly can thus be installed onto seal body 17 of the protector. Bolts 69, 71, 73, and 74, hold the flanges together, and an opening for a motor shat is illustrated at 77.

Figure 3:
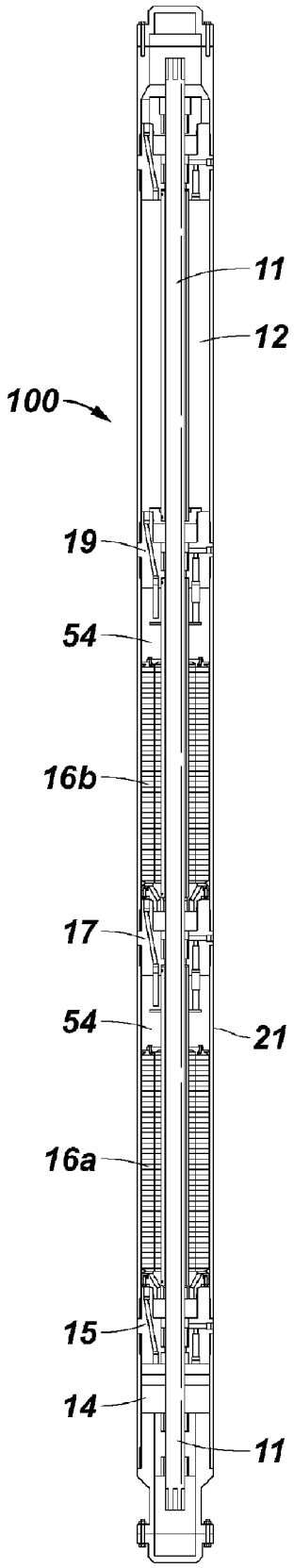
FIG. 3 is a schematic cross-section side elevation view through the longitudinal axis of a system of the invention having two of the two-piece protector apparatus of FIG. 2 installed therein.

FIG. 3 illustrates a cross-sectional view of embodiment 100 of the invention, and FIG. 4 illustrates, also in cross-section, more details of the two piece bellows installation of embodiment 100. Illustrated is a pump 12 and a motor 14, with the protector in this embodiment being in multiple bellows sections 16*a* and 16*b*, each having external/internal bellows construction as in embodiment 50 of FIG. 2. A seal section 15 for bellows section 16*a* and a seal section 17 for bellows section 16*b* are illustrate, as well as dielectric motor oil 54. A third seal section 19 is provided in this embodiment. Pump shaft 11 is illustrated. Note that the construction as detailed in FIG. 4 allows easier disassembly than previously known apparatus and systems by virtue of multiple pieces: external bellows 51 may be detached from internal bellows 53 by simply unscrewing bolts 69, 71, 73, and 75.

Referring now to the operation of the bellows assembly illustrated by FIGS. 2, 3 and 4, motor fluid 54 expands and contracts as motor 14 is activated and deactivated and as other temperature fluctuations affect the fluid volume. If motor fluid 54 expands, then bellows 51 and 53 expand accordingly. If motor fluid 54 contracts, then bellows 51 and 53 also contract. The spring force of the bellows ensures that motor fluid 54 is positively pressurized relative to the well fluid, regardless of whether motor fluid 54 has expanded or contracted (e.g., 10 psi, 25 psi, 50 psi or higher pressure differential). During or after submerging the systems of the invention, the system may release or inject oil in the motor to maintain the pressure of motor fluid 54 within a certain pressure range. Accordingly, external fluids (i.e., the well fluids) are continuously pressured away from the motor fluid of motor 14 to prevent undesirable corruption of the internal fluids and components of motor 14. The foregoing pressure ensures that if leakage occurs, the leakage is directed outwardly from motor fluid 54 to the well fluid, rather than inwardly from the well fluid into motor fluid 54 (i.e., the typical undesirable leakage/corruption of motor fluid 54). The positive internal pressure generally provides a better environment for the system 10. The positive pressure of motor fluid 54 provided by the bellows also may be used to periodically flush fluids through the bearings and seals to ensure that the bearings and seals are clean and operable.

Throughout the life of apparatus and systems of the invention, motor fluid tends to leak outwardly through the shaft seals and into the external fluids. By itself, this gradual leakage tends to decrease the pressure of motor fluid 54. However, the bellows compensate for the leakage to maintain a certain positive pressure range within motor fluid 54. In the embodiments illustrated in FIGS. 2, 3, and 4 the bellows compensate by contracting (due to the spring force). In other embodiments, the bellows may compensate by expanding (also due to the spring force).

The bellows also may have various protection elements to extend their life and to ensure continuous protection of motor 14. For example, a filter may be disposed between ports and the exterior of the bellows to filter out undesirable fluid elements and particulates in the well fluid prior to fluid communication with the exterior. A filter also may be provided adjacent the interior of the bellows to filter out motor shavings and particulates. If used, the filter may be positioned adjacent a moisture absorbent assembly between a motor cavity and the interior of the bellows. Accordingly, the filter may prevent solids from entering or otherwise interfering with the bellows, thereby ensuring that the bellows is able to expand and contract along with volume variations in the fluids.

A plurality of expansion and contraction stops also may be disposed about bellows 51, 53 to prevent over and under extension and to prolong the life of the bellows. For example, a contraction stop may be disposed within the interior of either bellows to contact an end section and limit contraction of the bellows. An expansion stop also may be provided.

Contraction and expansion stops may have various configurations depending on the material utilized for the apparatus and also depending on the pressures of motor fluid 54 and the well fluid. A housing 21 also may be disposed about the exterior of external bellows 51 to guide the bellows during contraction and expansion and to provide overall protection.

As discussed above, motor fluid 54 may be pressurized significantly prior to submersing the system 10. As system 10 is submersed and activated in the downhole environment, the internal pressure of motor fluid 54 may rise and/or fall due to temperature changes, such as those provided by the activation and deactivation of motor 14. Accordingly, various valves may be disposed within housing 21 to control the pressurization of motor fluid 54 and to maintain a suitable positive pressure range for motor fluid 54. For example, a valve may be provided to release motor fluid 54 when the pressurization exceeds a maximum pressure threshold. In addition, another valve may be provided to input additional motor fluid when the pressurization falls below a minimum pressure threshold. Accordingly, the valves maintain the desired pressurization and undesirable fluid elements are repelled from the motor cavity at the shaft seals.

System 10 also may have a wiring assembly extending through housing 21 to a component adjacent a bellows. For example, a variety of monitoring components may be disposed near one of the bellows to improve the overall operation of system 10. Exemplary monitoring components comprise temperature gauges, pressure gauges, and various other instruments, as should be appreciated by those skilled in the art.

As discussed above, apparatus of the invention may have various configurations. For example, certain apparatus and systems of the invention may comprise a motor protector 16 that comprises a seal section 17 and a bellows section 51, 53 (FIG. 4). As illustrated in embodiment 100 of FIG. 3, seal section 17 may be disposed between pump 12 and motor 14, while a protector 16*a* is disposed adjacent motor 14, and another protector 16*b* is disposed on an opposite side of seal section 17. System 100 may also have an optional monitoring system disposed adjacent one of protectors 16*a* and/or 16*b*. If additional sealing and motor protection is desired, then a plurality of seal and bellows sections may be disposed about the motor 14 in desired locations. For example, certain systems of the invention may have multiple bellows sections disposed sequentially and/or on opposite sides of motor 14, such as a bellows section having two bellows assemblies in series.

Seal sections of a motor protector may have various seal and protection elements disposed about shaft 11 within housing 21. These elements may be provided to protect motor 14 from undesirable fluid elements in pump 12 and wellbore. Accordingly, the seal section may have a plurality of shaft seals disposed about shaft 11 to seal and isolate motor fluid 54 from the undesirable fluids (e.g., the well fluid, or injected fluid). Seal sections may also have a thrust bearing disposed about shaft 11 to accommodate and support the thrust load from pump 12. A moisture absorbent assembly also may be disposed about shaft 11 to remove undesirable fluids from the internal fluid (i.e., motor fluid 54 within housing 21).

As discussed above, the internal fluid of systems of the invention may be positively pressurized to prevent in-flow of the undesirable fluids through the shaft seals. In a section between shaft seals, a relief valve may be provided to release internal fluid from the system when the internal pressure exceeds the maximum pressure threshold. According to these embodiments, the technique maintains the internal fluid within a certain positively pressurized pressure range to prevent in-flow of undesirable fluids through the shaft seals, while also allowing a pressure release when the internal pressure exceeds the maximum pressure threshold. This technique ensures that fluid is repelled and ejected under pressure rather than allowing the undesirable fluids to slowly migrate into the system, such as in a pressure balanced system. However, the apparatus and systems of the present invention also may utilize various pressure balancing assemblies to complement the seal and bellows sections. For example, a seal section may include a labyrinth or bag assembly between shaft seals.

The bellows sections of the motor protectors 16*a* and 16*b* have the bellows disposed in a housing 21, which may be coupled to motor 14 at a coupling section and to another component at a different coupling section. Inside housing 21, bellows 51 and 53 are oriented such that an interior is in fluid communication with the well fluid through various ports, as is known in the art. An external filter assembly may be disposed about the ports to filter out undesirable elements within the well fluid. The exterior of bellows 51 and 53 are in fluid communication with motor fluid 54. The bellows may also have a filter disposed between the bellows and motor 14. For example, a filter assembly may be disposed at an expansion stop 79 of housing 21 to filter out motor shavings and other harmful elements. Accordingly, the filter assemblies filter out undesirable elements from motor fluid 54 and the well fluid to protect the bellows. In this configuration, motor fluid 54 contracts bellows 51 and 53 as it is injected into motor 14, while the well fluid acts against the bellows as the system is submersed into the well.

As discussed above, the bellows may be movably disposed within a housing. As motor fluid 54 expands and contracts due to temperature changes, bellows 51 and 53 contract or expand to a new resting position, where the internal motor pressure is balanced against the well pressure plus the spring force of the bellows. If motor fluid 54 expands, the bellows of this embodiment contracts accordingly. If motor fluid 54 contracts, the bellows of this embodiment expands accordingly. Motor fluid 54 in this embodiment, therefore, remains positively pressurized in relation to well fluids, regardless of whether or not it has been expanded or contracted due to temperature variations.

The bellows also may utilize various spring assemblies and other biasing structures to facilitate pressurization of motor fluid 54. For example, a spring assembly may be incorporated into the bellows assembly to complement the resistance of the bellows and increase the stroke of the bellows (thereby increasing the time and range in which the bellows will maintain a positive pressure on motor fluid 54). The orientation of the bellows also may be varied to accommodate a particular pumping system and application.

Moreover, as discussed in further detail below, apparatus of the present invention may be used alone or separate, in duplicate, in series, in parallel, or in any suitable configuration to provide optimal protection for motor 14. For example, as illustrated in FIG. 3, a plurality of protector bellows 16*a* and 16*b* may be disposed in series. Alternatively, the protector bellows may be arranged longitudinally adjacent one another in a bellows section, each bellows having a longitudinally adjacent set of ports and filters for fluid communication with the well fluid. The opposite side of each bellows assembly is then in fluid communication with motor fluid 54.

Systems of the invention may also comprise a variety of conventional motor protector components, such as a bag assembly and a labyrinth assembly, for example, system 100 may have pump 12, seal section 17, motor 14 and bellows section sequentially intercoupled. The bellows section may have the bellows oriented such that the interior is in fluid communication with the well fluid, while the exterior is in fluid communication with motor fluid 54. Although FIGS. 3 and 4 do not illustrate the various filters and other protection elements for the bellows, the bellows sections may include a variety of filters, seals, moisture absorbent assemblies, housings, bellow stops, and other desired bellows protection elements configured to prolong the life of the bellows assembly, as previously described. The seal section will have shaft seals disposed about respective chambers which have a bag assembly and a labyrinth assembly disposed therein to provide pressure balancing between the shaft seals. The seal section also may utilize a variety of other pressure balancing components, such as conventional bag assemblies, conventional labyrinth assemblies, and various bellows and labyrinth assemblies of the present technique. A plurality of pressure check valves may also be disposed in the seal section to control the positively pressurized fluid within system 100. For example, a valve (not shown) may be configured to monitor the pressure and to trigger a backup oil supply when the pressure falls below the minimum pressure threshold in motor 14 (e.g., 5 psi). For example, if the bellows fails to expand or contract as in normal operation, then the valve acts as a backup to ensure a desired pressure range for motor fluid. The valve may be configured to monitor the pressure and to release the positively pressurized motor fluid 54 within motor 14 when the internal pressure exceeds the maximum pressure threshold. Accordingly, the valve ensures that the O-ring seals in the pothead, the joints, and various other components in the seal section are protected from excessive pressure differentials.

Alternate configurations of the seal and bellow sections are possible. In certain embodiments the seal section and the bellows section may be sequentially disposed between pump 12 and motor 14. These systems may also have an optional monitoring system disposed adjacent motor 14 and opposite bellows 51, 53. In certain other embodiments, the seal section and the bellows section may be sequentially disposed between pump 12 and motor 14. However, an additional bellows section may be disposed below motor 14 to complement bellows section disposed above motor 14. Systems of the invention may also have an optional monitoring system disposed below the relatively lower bellows section. Accordingly, the seal and bellows sections may be oriented at various locations relative to pump 12 and motor 14, while also including a plurality of seal and bellows sections to improve the effectiveness of the overall motor protection technique. It also should be noted that the seal sections may include conventional motor protection components.

As discussed briefly, one problem has been the difficulty in cleaning the bellows in a timely and cost effective manner, in particular the annular region between bellows 51 and 53. Apparatus and systems of the invention address this problem by providing multi-piece protectors, such as previously described in reference to FIG. 2, a non-limiting embodiment. Apparatus of the invention may be used to protect motors and other components in any combination. In certain apparatus embodiments, the body comprises an assembly of two or more pieces that may be disassembled and cleaned without great difficulty, as compared with conventional single piece annular bellows apparatus. Certain multi-piece bellows assemblies of the invention may be dismantled and cleaned in a simpler fashion than one-piece bellows. For instance, the multiple-piece bellows may be cleaned with a commercial steam cleaner, or other methods including but not limited to chemical cleaning and ultrasonic cleaning to significantly reduce the cost for the bellows cleaning processes. Bolts 69, 71, 73, and 75 in embodiment 50 of FIG. 2 allow this facile cleaning. Other connectors may be employed with similar results.

Systems of the invention also may have a variety of alternate configurations of the apparatus for positioning the bellows about the shaft 11. For example, the bellows may embody an annular or ring-shaped enclosure, which may be fixed at one or both ends to provide a fixed seal and an expandable/contractible volume. Accordingly, the bellows avoids use of sliding seals, which typically cause leakage into the motor fluid. In this embodiment, the fluid pressures on opposite sides of the bellows may be relatively balanced rather than providing a significant pressure differential between the fluids. However, it is understood that a slight pressure differential, such as 5 psi, may be provided in this pressure-balanced configuration of the bellows assembly. Another protector component (e.g., a bellows assembly, a bag assembly, a labyrinth assembly, etc.) may be coupled to the section. Alternatively, if a labyrinth assembly is coupled to the section, then the interior of the annulus or ring-shaped enclosure may be in fluid communication with a desired isolation fluid configured to facilitate separation from the well fluid in the labyrinth assembly. In either configuration, a filter assembly may be disposed adjacent the port to filter out undesirable elements within the well fluid or the desired isolation fluid. The exterior of external bellows 51 is in fluid communication with motor fluid 54 via ports. Alternatively, the exterior may be in fluid communication with a second isolation fluid for a second labyrinth assembly, a bag assembly, or any other desired fluid separation assembly. As described in detail above, the bellows also may include a variety of bellows protection elements, such as guides, seals, filters and absorbent packs (e.g., moisture absorbent packs). The bellows also may comprise one or more shaft seals, thrust bearings, and various other seals and bearings. For example, the bellows may have shaft seals disposed about the shaft 11 on opposite sides of the bellows. A thrust bearing may also be disposed about shaft 11.

As discussed above, the bellows may be balanced pressure bellows rather than a positively pressurized bellows. In operation of balanced pressure bellows, injection and expansion of motor fluid in motor 14 (or other isolation fluid) and the exterior causes the bellows to contract. In contrast, the pressure of the well fluid (or other isolation fluid) causes the bellows assembly to expand. As motor fluid expands and contracts due to temperature changes, the bellows contracts or expands to a new resting position, where the internal motor pressure is balanced against the well pressure plus any resistance of the bellows. If motor fluid (or other isolation fluid) expands, the bellows of this embodiment contracts accordingly. If the motor fluid (or other isolation fluid) contracts, the bellows of this embodiment expands accordingly. Accordingly, bellows substantially balances the pressures between the motor fluid and the well fluid under a wide range of operating conditions, which include both expansion and contraction of motor fluid 54. If a positive pressure differential is desired in the bellows, then a spring assembly can be incorporated into the bellows to prevent inward leakage of undesirable elements such as the well fluid.

As noted above, the bellows may be fixed at one or both ends. Embodiment 100 illustrated in FIGS. 3 and 4 has the bellows protector 16*a* and 16*b* fixed to a seal section 15 and 17, while an opposite end is free to expand and contract within housing 21. The particular length and spring stiffness of the bellows may be configured for any desired operating conditions and well environments. Additional bellows also may be incorporated into the bellows sections 16*a* and 16*b* to provide additional protection for motor 14.

The bellows also may have one or more stepped sections, which provide a fluid interface to facilitate expansion and contraction of the bellows. In these embodiments, the bellows is fixed at both ends, while the stepped section is movable as the well and motor fluids expand and contract. The stepped section acts as a fluid interface between large diameter and small diameter bellows sections. The particular lengths and spring stiffness of the bellows sections may be configured for any desired operating conditions and well environments.

The apparatus and systems of the invention may also include one or more labyrinth assemblies, bag or bladder assemblies, or other conventional motor protector assemblies to protect both motor 14 and the bellows 51 and 53. Moreover, the systems may comprise both a positively pressured bellows assembly along with a balanced pressure bellows assembly.

Additionally, the motor protectors 16 of system 100 may comprise a multi-orientable labyrinth assembly (i.e., operable in multiple orientations), which may be used alone or in combination with the bellows or other components. The multi-orientable labyrinth assembly has one or more conduits that extend in multiple directions to ensure fluid paths having peaks and valleys in multiple orientations of the multi-orientable labyrinth assembly. Accordingly, the peaks and valleys in these various orientations ensure continuous fluid separation in all orientations of the multi-orientable labyrinth assembly based on differences in specific gravity. Systems of the invention may have a multi-orientable labyrinth assembly disposed between pump 12 and motor 14. As described in other embodiments of the system 10, a variety of seals, couplings, bearings, filters, absorbents, and protection devices may be provided to protect and prolong the life of motor 14. Accordingly, system 100 may include couplings, a thrust bearing, and a solids processor. An exemplary solids processor may be disposed in a chamber between pump 12 and motor protector 16 to prevent solids from entering the multi-orientable labyrinth assembly and from generally corrupting the motor protection devices in the motor protector(s) 16. A suitable solids processor may include a variety of solids separators, such as shedder and shroud, which prevent solids from settling on and damaging bearings and seals such as shaft seals. The solids separator throws or sheds solids outwardly from the shaft 11 and shaft seal. The shroud, which may embody an extended length shedder in a deviated orientation, also prevents solids from settling near shaft 11 and damaging shaft seals. The solids processor may also include one or more flow ports that allow solids to escape into the wellbore. The multi-orientable labyrinth assembly may comprises a multi-directional winding of tubing, which is fluidly coupled to the motor and well fluids (or other isolation fluids) at its ends. The ends may be positioned in respective opposite ends of the motor protector 16. One end may be coupled to a port extending to motor 14, while the other end may be positioned openly within motor protector 16. The ends may also include a filter to prevent solids and other undesirable elements from entering the multi-orientable labyrinth assembly. The well fluid enters the motor protector 16 via a conduit, which also can include one or more filters to prevent the inflow of solids into the motor protector 16. In operation, a multi-directional winding of a multi-orientable labyrinth assembly maintains fluid separation of the motor and well fluids by using the differences in specific gravity of the fluids and multidirectional windings. A multi-orientable labyrinth assembly may have a plurality of crisscrossing and zigzagging tubing paths, which extend in multiple orientations (e.g., 2-D, 3-D, or any number of directions) to ensure that the fluids go through upward and downward movement regardless of the orientation of the system. For example, a multi-orientable labyrinth assembly may be operable in a vertical wellbore, a horizontal wellbore, or any angled wellbore. A multi-orientable labyrinth assembly may also be disposed in a variety of submersible pumping systems, including those illustrated in FIGS. 3 and 4. Moreover, a plurality of multi-orientable labyrinth assemblies may be disposed in series or in parallel in various locations within the system.

In one system configuration, a multi-orientable labyrinth assembly may be disposed in a chamber between the bellows and the well fluid to protect the bellows. In the foregoing system configuration, pump 12 and motor 14 may be positioned side by side, while the bellows and multi-orientable labyrinth assembly may be disposed adjacent motor 14. In contrast, in another embodiment the multi-orientable labyrinth assembly may be configured for positioning about shaft 11 in a central protector configuration. In this central configuration, the multi-orientable labyrinth assembly has an annular or ring-shaped geometry, which provides an inner conduit for shaft 11. In both embodiments, the multi-orientable labyrinth assembly may include one or more continuous tubes, which are interwoven in zigzagging and multi-directional patterns terminating at opposite ends of the labyrinth assembly. Moreover, the dimensions of the tubing, the density of the windings, and other geometrical features may be tailored to the specific system and downhole environment. A multi-orientable labyrinth assembly may also have an additional feature, as compared to conventional two-dimensional labyrinths. In two-dimensional labyrinths, the oil/well fluid interface occurs within the labyrinth chamber and not within one of the labyrinth tubes. In multi-orientable labyrinth assemblies, the interface may occur in the relevant chamber, but it may also occur within the multi-oriented tube thereby enabling the assembly to be used in any orientation (as previously discussed).

In another exemplary embodiment of systems of the invention, a plurality of the foregoing motor protector and seal devices may be disposed in parallel or in series within the system.

Accordingly, the present invention may embody a variety of system configurations and motor protectors 16 and corresponding devices, such as the bellows 51 and 53 and multi-orientable labyrinth assembly. As described above, the bellows may embody either a positively pressurized system or a balanced pressure system. The foregoing motor protectors 16 and corresponding devices may be used alone or together in any configuration, including multiples of each device and conventional motor protectors. Moreover, one or more of the motor protectors 16 can be disposed above, between or below pump 12 and motor 14. For example, if a balanced pressure bellows is disposed above motor 14 or between pump 12 and motor 14, then a positively pressurized bellows may be disposed below motor 14 in fluid communication with the well fluid. Moreover, any of the foregoing motor protectors 16 and corresponding devices may be functionally combined in series or in parallel, or any combination thereof.

Exemplary materials of construction for apparatus and systems of the invention comprise a metal selected from metals chemically compatible with expected environmental conditions, heat treated metals, corrosion resistant metals, high strength metals, and metals having two or more of these properties. Hastelloy "C" is a good choice for most pumps because of its chemical compatibility, but it may not be thick enough for a Hastelloy "C" pump. Most bellows convolutions are only 0.004 inches (0.10 mm) thick and one definition of "corrosion resistant" is that the material can corrode up to 0.002 inches (0.05 mm) per year. The 300 series of stainless steel, while high in strength, may cause chloride stress corrosion problems. One heat treatable form of stainless steel is type AM350, which has been used successfully for many years in high temperature and cryogenic seal applications. Heat-treated materials tend to retain their strength and spring rate at elevated temperatures expected in wellbores. Inconel 718 is a metal that has good corrosion resistant properties in an annealed form and retains some of the corrosion resistant properties after heat testament. It has become the favorite of oil refinery people because of corrosion problems they have experienced with type AM350 stainless steel after five or six years of service. Titanium, 17-4 PH and variety of other materials have been used as bellows seals.

Metal apparatus of the invention may have coatings, including polymeric coatings. "Coating" as used herein as a noun, means a condensed phase formed by any one or more processes. The coating may be conformal (i.e., the coating conforms to the surfaces of the inventive apparatus), although this may not be necessary in all oilfield applications or all apparatus, or on all surfaces of the apparatus. Conformal coatings based on urethane, acrylic, silicone, and epoxy chemistries are known, primarily in the electronics and computer industries (printed circuit boards, for example). Another useful conformal coating includes those formed by vaporization or sublimation of, and subsequent pyrolization and condensation of monomers or dimers and polymerized to form a continuous polymer film, such as the class of polymeric coatings based on poly (p-xylylene), commonly known as Parylene. Thermoplastic elastomers, which may be another type of polymeric coating, are generally the reaction product of a low equivalent molecular weight polyfunctional monomer and a high equivalent molecular weight polyfunctional monomer, wherein the low equivalent weight polyfunctional monomer is capable, on polymerization, of forming a hard segment (and, in conjunction with other hard segments, crystalline hard regions or domains) and the high equivalent weight polyfunctional monomer is capable, on polymerization, of producing soft, flexible chains connecting the hard regions or domains. Another class of useful polymeric coatings are thermally curable coatings derived from coatable, thermally curable coating precursor solutions, such a those described in U.S. Pat. No. 5,178,646, incorporated by reference herein. Two other classes of useful coatings are condensation curable and addition polymerizable resins, wherein the addition polymerizable resins are derived from a polymer precursor which polymerizes upon exposure to a non-thermal energy source which aids in the initiation of the polymerization or curing process. Examples of non-thermal energy sources include electron beam, ultraviolet light, visible light, and other non-thermal radiation. Examples of useful organic resins to form these classes of polymeric coating include methylol-containing resins such as phenolic resins, urea-formaldehyde resins, and melamine formaldehyde resins; acrylated urethanes; acrylated epoxies; ethylenically unsaturated compounds; aminoplast derivatives having pendant unsaturated carbonyl groups; isocyanurate derivatives having at least one pendant acrylate group; isocyanate derivatives having at least one pendant acrylate group; vinyl ethers; epoxy resins; and mixtures and combinations thereof. The term "acrylate" encompasses acrylates and methacrylates.

For embodiments wherein a better bond between the polymeric coating and the metal portions of the apparatus is desired, mechanical and/or chemical adhesion promotion (priming) techniques may used. The term "primer" as used in this context is meant to include both mechanical and chemical type primers or priming processes. Examples of mechanical priming processes include, but are not limited to, corona treatment and scuffing, both of which increase the surface area of the apparatus. An example of a preferred chemical primer is a colloidal dispersion of, for example, polyurethane, acetone, isopropanol, water, and a colloidal oxide of silicon, as taught by U.S. Pat. No. 4,906,523, which is incorporated herein by reference.

As may be seen by the exemplary embodiments illustrated in FIGS. 2-4 there are many possible uses of apparatus and systems of the invention. Alternatives are numerous. For example, certain electrical submersible pumps, which are modified versions of a pumping system known under the trade designation Axia™, available from Schlumberger Technology Corporation, may feature a simplified two-component pump-motor configuration. Pumps of this nature generally have two stages inside a housing, and a combined motor and protector, which may comprised an apparatus of the invention. This type of pump may be built with integral intakes and discharge heads. Fewer mechanical connections may contribute to faster installation and higher reliability of this embodiment. The combined motor and protector assembly is known under the trade designation ProMotor™, and may be prefilled in a controlled environment. The pump may include integral instrumentation that measures downhole temperatures and pressures.

Other alternative electrical submersible pump configurations that may benefit from apparatus of the invention include an ESP deployed on cable, an ESP deployed on coiled tubing with power cable strapped to the outside of the coiled tubing (the tubing acts as the producing medium), and more recently a system known under the trade designation REDACoil™, having a power cable deployed internally in coiled tubing. Certain pumps may have "on top" motors that drive separate pump stages, all pump stages enclosed in a housing. A separate protector may be provided, as well as an optional pressure/temperature gauge. Also provided in this embodiment may be a sub-surface safety valve (SSSV) and a chemical injection mandrel. A lower connector may be employed, which may be hydraulically releasable with the power cable, and may include a control line and instrument wire feedthrough. A control line set packer may be included in this embodiment. The technology of bottom intake ESPs (with motor on the top) has been established over a period of years. It is important to securely install pump stages, motors, and protector within coiled tubing, enabling quicker installation and retrieval times plus cable protection and the opportunity to strip in and out of a live well. This may be accomplished using a deployment cable, which may be a cable known under the trade designation REDACoil™, including a power cable and flat pack with instrument wire and one or more, typically three hydraulic control lines, one each for operating the lower connector release, SSSV, and packer setting/chemical injection.

Systems of the invention may include many optional items. One optional feature may be one or more sensors located at the protector to detect the presence of hydrocarbons (or other chemicals of interest) in the internal motor lubricant fluid. The chemical indicator may communicate its signal to the surface over a fiber optic line, wire line, wireless transmission, and the like. When a certain chemical is detected that would present a safety hazard or possibly damage a motor if allowed to reach the motor, the pump may be shut down long before the chemical creates a problem.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

(a) a protector body comprising a material allowing expansion and contraction of an internal fluid, and serving as a barrier between fluids external of the protector body and the internal fluid, the protector body having first and second ends, at least one of the first and second ends adapted to connect the protector body to other components of a pump; and (b) the protector body having an assembly of two or more bellows pieces fastened together by a fastener mechanism, the fastener mechanism being operable to enable selective engagement of the two or more bellows pieces during operation of the apparatus and disengagement of the two or more bellows pieces when desired by an operator to permit facile cleanout and reuse of the protector body.

2. The apparatus of claim 1 wherein the protector body is adapted to protect a motor of the pump exposed to a subterranean environment.

3. The apparatus of claim 2 wherein the protector body, motor and pump are parts of a submersible pumping system.

4. The apparatus of claim 1 wherein the assembly is selected from the group consisting of an assembly comprising an inner bellows and an outer bellows; assemblies comprising one outer bellows and two or more inner bellows in series, each of the inner bellows shorter in length than the outer bellows; and assemblies comprising one inner bellows and two or more shorter outer bellows in series.

5. The apparatus of claim 1 comprising materials able to withstand temperatures, pressures, temperature and pressure variations, and organic, inorganic and mixtures of inorganic and organic compositions.

6. The apparatus of claim 5 wherein the materials are selected from metals, polymeric materials selected from natural and synthetic polymers, combinations and composites of metals and polymeric materials, blends of natural and synthetic polymers, and layered and coated versions of polymeric materials and metals, wherein individual layers and coatings may be the same or different in composition and thickness.

7. The apparatus of claim 6 wherein the material comprises a metal selected from metals chemically compatible with expected environmental conditions, heat treated metals, corrosion resistant metals, high strength metals, and metals having two or more of these properties.

8. The apparatus of claim 1 wherein the second end is adapted to connect the protector body to a motor seal.

9. A pumping system comprising:

(a) one or more pump motors; and (b) an apparatus comprising a protector body for the pump motor, the protector body comprising a material allowing expansion and contraction of an internal fluid, and serving as a barrier between fluids external of the protector body and the internal fluid, the protector body having first and second ends, at least one of the first and second ends adapted to connect the protector body to another component of the pumping system, the protector body having a multi-piece bellows and a fastening mechanism engaging separable pieces of the multi-piece bellows, the fastening mechanism being releasable for disengagement of the pieces to enable facile cleanout and reuse of the protector body.

10. A method comprising:

(a) selecting one or more pumping systems comprising one or more pump motors and an apparatus comprising a protector body for the pump motor, the protector body comprising a material allowing expansion and contraction of an internal fluid, and serving as a barrier between fluids external of the protector body and the internal fluid, the protector body having first and second ends, at least one of the first and second ends adapted to connect the protector body to another component of the pumping system;

(b) constructing the protector body as an assembly of two or more bellows pieces fastened together by a fastener mechanism, the fastener mechanism being operable to enable selective engagement of the two or more bellows pieces during operation of the apparatus and disengagement of the two or more bellows pieces when desired by an operator to permit facile cleanout and reuse of the protector body; and (c) using the pumping system in an oilfield operation, the oilfield operation exposing the pumping system to a wellbore environment.

11. The method of claim 10 comprising disassembling the apparatus and cleaning with a method selected from the group consisting of steam cleaning, chemical cleaning , ultrasonic cleaning, baking, blasting, and combinations thereof.

12. The method of claim 10 comprising running one or more oilfield tools into the wellbore prior to, during, or after using the pumping system.

13. The method of claim 12 wherein the oilfield operation is selected from the group consisting of raising a hydrocarbon from a reservoir, circulating a fluid in at least a portion of the wellbore, and retrieving an oilfield element from the wellbore.

* * * * *